United States Patent [19]

MacFarlane

[11] 4,088,201

[45] May 9, 1978

[54] PORTABLE FIRE ESCAPE

[76] Inventor: James L. MacFarlane, 2209 Paradise Rd., Las Vegas, Nev. 89104

[21] Appl. No.: 698,051

[22] Filed: Jun. 21, 1976

[51] Int. Cl.[2] ..... A62B 1/08

[52] U.S. Cl. ..... 182/5

[58] Field of Search ..... 182/5, 6, 7; 254/158, 254/160; 188/268

[56] References Cited

U.S. PATENT DOCUMENTS

| | | | |
|---|---|---|---|
| 439,191 | 10/1890 | Roper | 254/158 |
| 516,117 | 3/1894 | Roper | 254/158 |
| 3,241,642 | 3/1966 | King | 188/268 |
| 3,847,377 | 11/1974 | Byrd | 254/158 |
| 3,871,501 | 3/1975 | Kornylak | 188/268 |

*Primary Examiner*—Reinaldo P. Machado
*Attorney, Agent, or Firm*—Seiler & Quirk

[57] ABSTRACT

A fire escape device includes a portable spool journalled in a casing including a safety hook for suspending the spool from an eyebolt installed in elevated relation to ground level. A support line is wound about the spool and includes a body harness at its free end. For retarding rapid descent of a human body in the harness, a cylindrical rotor extends coaxially from the spool for joint rotation therewith. The spool lies within a cylindrical cup supported by the casing defining a fluid tight chamber coaxially about the rotor. The chamber is filled with a viscous fluid to provide viscous friction forces in the circumference of the rotor. The viscous fluid is dimethyl siloxane having a density between $0.65 \times 10^6$ and $2.0 \times 10^6$ centistokes and the annular gap between the rotor and the cup is chosen to achieve a descent rate ranging between 3 and 5 feet per second for a human body weighing 250 pounds.

4 Claims, 3 Drawing Figures

PORTABLE FIRE ESCAPE

FIELD OF THE INVENTION

The present invention relates generally to a fire escape formed by a safety line unwindable from a spool and configured for carrying a descending human body at its free end. In its particular aspects the present invention relates to the provision of a viscous friction device for retarding rotation of said reel for achieving a predetermined descent rate of the human body.

BACKGROUND OF THE INVENTION

While new buildings have been constructed in accordance with stringent fire prevention and safety standards, it is an all too frequent occurrence that people are killed because of entrapment in upper floors of buildings by fire. Although portable safety line reel type fire escape devices have been proposed heretofore to my knowledge none of these has seen any significant degree of actual use.

A major problem encountered in producing a safety line reel type fire escape is the need to show the descent of the human body carried by the free end of the support line to a reasonable preferably constant rate of descent. Thus, in the prior art various mechanical braking devices were utilized to show rotation of the reel during unwinding of the line as in U.S. Pat. No. 383,432.

Also the prior art considered, in U.S. Pat. Nos. 1,145,923 and 3,861,496, the use of a piston coupled to the spool for forcing a fluid or granular material through a restricted orifice. Unfortunately, these techniques did not result in a substantially constant descent rate and were inherently expensive and bulky.

OBJECTS OF THE INVENTION

It is an object of the present invention to provide a fire escape safety line spool which is linked to viscous damping means for producing a predetermined rate of descent of a human body carried by the line.

It is another object of the present invention to produce a compact, effective, light weight, simple and inexpensive portable fire escape.

SUMMARY OF THE INVENTION

Briefly, the aforementioned and other objects of the present invention are satisfied by providing a fire escape device including a spool journalled in support means configured to be maintained elevated relative to ground level. A safety line is wound upon the spool and has at its free end a means for carrying a human body, whereby the body may descend from an elevated location by the line unwinding from said spool and forcing rotation thereof.

A generally cylindrical rotor extneds coaxially from the spool and is coupled to the spool fixedly for joint rotation therewith. A housing means formed about the rotor, is carried fixedly by the support means and defines a generally cylindrical fluid-tight chamber in which the rotor is coaxially disposed. This chamber is filled with an extremely viscous fluid for exerting a viscous friction force on the circumference of the rotor. The fluid is dimethyl siloxane having a viscosity selected from between $0.65 \times 10^6$ and $2.0 \times 10^6$ centistokes. The annular gap between the circumference of the rotor and the housing is selected to achieve a descent rate of a human body weighing 250 pounds which ranges between 3 and 5 feet per second.

Other objects, features and advantages of the present invention will become apparent upon perusal of the following detailed description of the preferred embodiment thereof when taken in conjunction with the appended drawing wherein.

DETAILED DESCRIPTION

Figure 1:
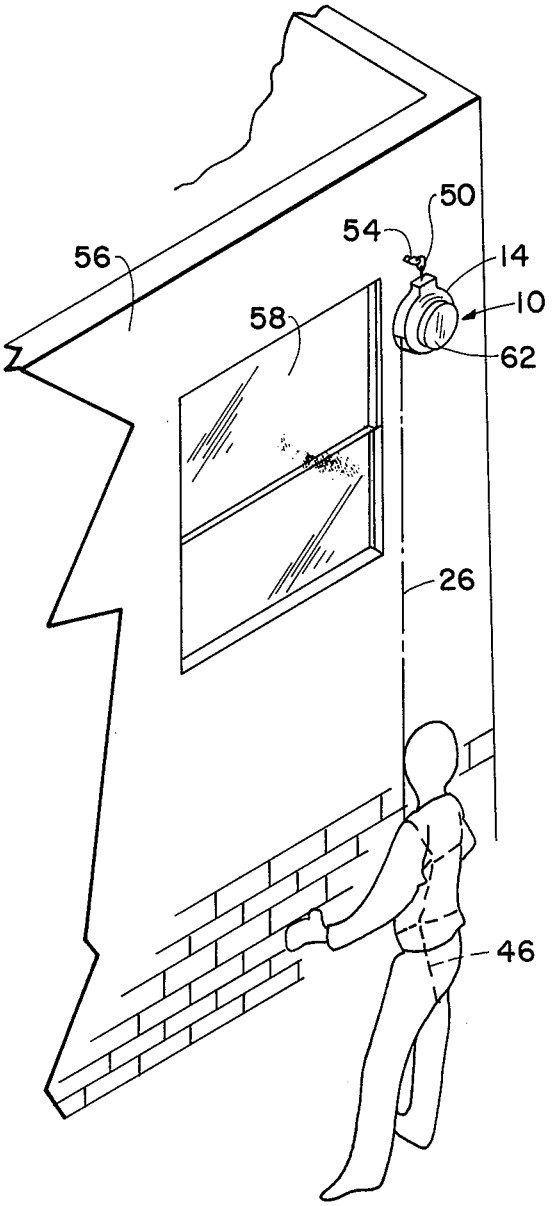
FIG. 1 is a generally elevational pictorial presentation depicting the fire escape of the present invention in use.
Figure 2:
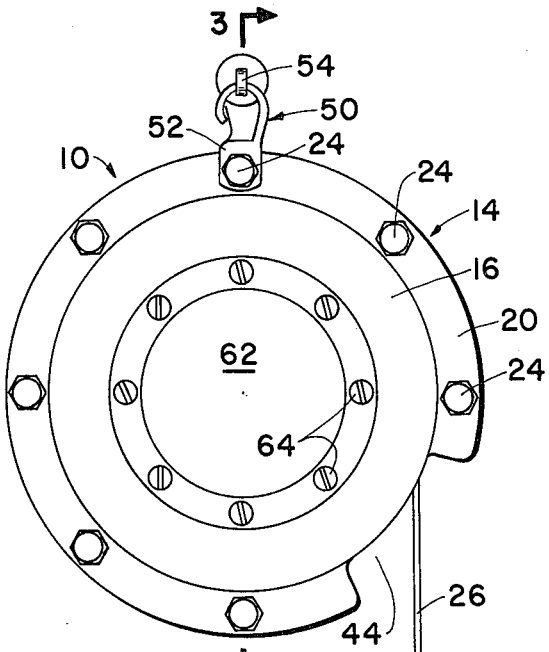
FIG. 2 is a front elevational view of the fire escape of the present invention.
Figure 3:
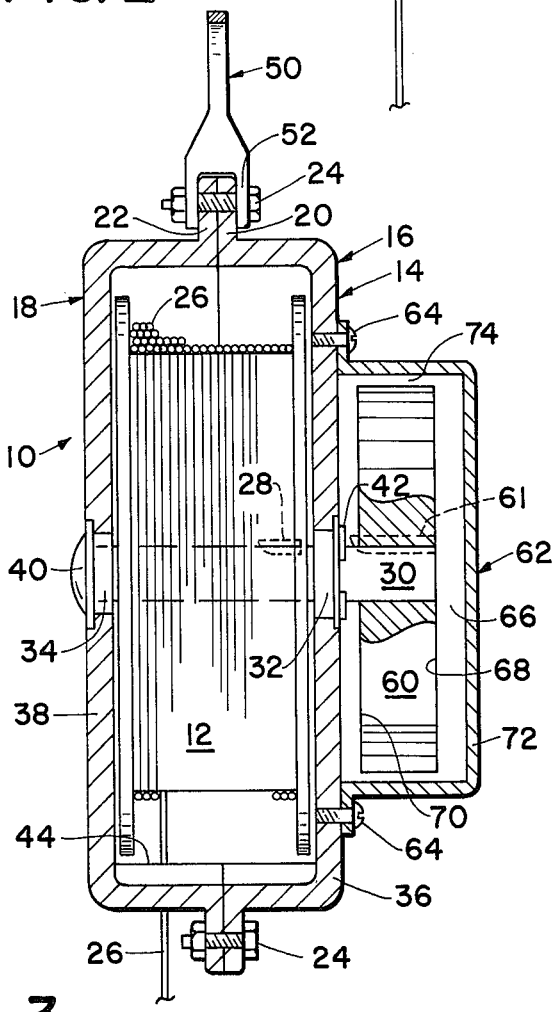
FIG. 3 is a partially cross-sectional elevational view taken through the lines 3—3 in FIG. 2.

Referring to FIGS. 1 through 3 of the drawing, the portable fire escape of the present invention is generally indicated by the reference numeral 10 and is seen to include a spool 12 journalled for rotation in a generally cylindrical cast aluminum housing 14 coaxially disposed about the spool. The housing 14 is formed of front and rear half sections 16 and 18 which mate at radial flanges 20 and 22 which are clamped together with machine bolts 24. Housing 14 is generally six inches in outside diameter and two and a half inches in length.

Spool 12 is preferably aluminum and has a diameter at the area about which a flexible cable or support line 26 is wound of about three inches. The spool 12 is keyed at 28 to a mild steel rotatable shaft 30 located along the axis of housing 14. Shaft 30 is journalled in sealed bearings 32 and 34 respectively carried centrally by the front and rear generally planar end walls 36 and 38 of housing 14 and terminates at its rear end with an integral head 40 carried against the rear side of bearing 34. The front end shaft 30 protrudes forwardly from front wall 36 and carries a removable snap ring 42 for lying against bearing 32 to appropriately prevent axial movement of the shaft relative to housing 14.

The cable 26 exits the housing 14 through an angular slot 44 in the lower part of its circumference and terminates at its free end in any suitable body harness 46 for engaging and carrying a human body 48.

A safety hook 50 at the top of the housing 40 has a mounting yoke portion 52 engaged about the flanges 20, 24 and joined to the flanges by one of the bolts 24. Hook 40 is configured to be engaged on an eye bolt 54 installed on a building 56 proximate a window 58 through which emergency exit can be made. Thus, for emergency escape from building 56, fire escape device 10 is hooked onto eye bolt 54 and the individual places the harness 46 about his body and jumps to descend along the building as the force of his weight exerts a torque on spool 12 for rotating the spool and unwinding the cable 26.

To retard rapid rotation of spool 12 for yielding a predetermined reasonable descent rate of the individual, the portion of shaft 30 which protrudes from housing front wall 36 carries a cylindrical aluminum rotor 60 coaxially via a key 61 to require that the rotor 60 and spool 12 rotate as a unit. The rotor 60 is preferably about three inches in diameter and three quarters of an inch in length. An aluminum radially flanged, generally cylindrical cup 62 is fastened at its flange via machine bolts 64 to the housing front wall 36. With reference to FIG. 3, it will be noted that the cup 62 coaxially surrounds rotor 60 and defines a cylindrical fluid-tight chamber 66 in which the rotor is coaxially disposed.

The front and rear generally planar surfaces 68 and 70 are respectively preferably spaced from the front planar wall 72 of cup 62 and from the front wall 36 of housing 14 by about two tenths of an inch. Further, a radial or annular gap 74 between the circumference of rotor 60 and the cup 62 is chosen in a manner to be hereinafter explained.

The chamber 66 is filled with an extremely viscous fluid, preferably dimethyl siloxane ranging in viscosity between $0.65 \times 10^6$ and $2.0 \times 10^6$ centistokes. As should be apparent, as the rotor 60 turns, this viscous fluid exerts a viscous friction force on the circumferential periphery of the rotor producing a torque retarding rotation of the rotor 60 and consequently the spool 12. Since the viscous friction torque is proportional to the angular velocity of the rotor 60, it should be apparent that given the weight of the individual in harness 46, the gap 74 can be selected to achieve a predetermined constant descent weight of the individual. A preferable design technique is to consider the body weight of the individual as 250 pounds and to determine the dimension of gap 74 for a preferable substantially constant descent rate ranging between 3 to 5 feet per second. In the case of fluid viscosity of $0.7 \times 10^6$ centistokes a 4 feet per second descent rate is achieved with a gape of 2 millimeters.

While the preferred embodiment of the present invention has been described and illustrated in specific detail it should be understood that numerous modifications, additions and omissions in the details thereof are possible within the intended spirit and scope of the invention claimed herein.

What is claimed is:

1. A fire escape device comprising: a spool; spool support means for journalling said spool for rotation, said support means being adapted to be maintained elevated relative to ground level; a support line wound about said spool for selective unwinding; means on the free end of said line for carrying a human body; a generally cylindrical rotor coupled coaxially to said spool for joint rotation therewith, said rotor having a smooth, uninterrupted circumferential periphery; a stationary housing carried by said support means defining a fluid-tight generally cylindrical smooth, uninterrupted chamber having a constant volume coaxially surrounding said rotor, and a viscous fluid having a viscosity of at least about 650,000 centistokes in said chamber completely filling said chamber for retarding rotation of said rotor by exerting a viscous friction force on said circumferential periphery of said rotor.

2. The device of claim 1 wherein said viscous fluid is dimethyl siloxane.

3. The device of claim 1 wherein said viscous fluid has a viscosity ranging between $0.65 \times 10^6$ and $2.0 \times 10^6$ centistokes.

4. The device of claim 1 wherein an annular gap is defined in said chamber between the circumferential periphery of said rotor and said housing, the width of said gap being selected in relation to the viscosity of said fluid to yield a descent rate of a human body weighing 250 pounds ranging between 3 and 5 feet per second.

* * * * *